United States Patent [19]

Kawasaki et al.

[11] Patent Number: 4,987,645

[45] Date of Patent: Jan. 29, 1991

[54] AUTOMATIC PIECING OF OVERLAPPED LEADING AND TRAILING ENDS OF SLIVERS IN A TEXTILE MACHINE

[75] Inventors: Yoshio Kawasaki, Shimada; Yoshiaki Kishita; Tatsutake Horibe, both of Horibe; Masakatsu Fujii, Ogaki; Keiji Onoue, Kariya, all of Japan

[73] Assignee: Kabushiki Kaisha Toyoda Jidoshokki Seisakusho, Aichi, Japan

[21] Appl. No.: 408,732

[22] Filed: Sep. 18, 1990

[30] Foreign Application Priority Data

Sep. 21, 1988 [JP] Japan ..... 63-237145

[51] Int. Cl.[5] ..... D01G 23/00; D01H 15/00; B65H 54/22

[52] U.S. Cl. ..... 19/25; 19/150; 19/157; 19/159 R; 19/159 A; 19/144

[58] Field of Search ..... 19/2, 21, 22, 23, 24, 19/25, 150, 157, 159 R, 159 A

[56] References Cited

U.S. PATENT DOCUMENTS

| | | | |
|---|---|---|---|
| 3,246,371 | 4/1966 | Tooka | 19/159 A |
| 4,195,388 | 4/1980 | Bulla | 19/157 |
| 4,829,758 | 5/1989 | Gilhaus | 19/157 X |
| 4,838,018 | 6/1989 | Hoeber | 19/157 X |
| 4,875,256 | 10/1989 | Gunkinger | 19/159 A |

*Primary Examiner*—Werner H. Schroeder
*Assistant Examiner*—Ismael Izaguirre
*Attorney, Agent, or Firm*—Burgess, Ryan & Wayne

[57] ABSTRACT

A first sliver in an exhaust can (2F) is introduced and held in a recess (38*a*) of a sliver piecing unit (38) while gripped by a sliver gripper (34). The first sliver is severed by the displacement of the gripper (34) away from the recess (38*a*) so that a trailing end of the first sliver is formed in the recess (38*a*). Next, a second sliver in a reserve can (2B) is introduced and held in the recess (38*a*) in the same way as for the first sliver and a leading end of thereof is formed in the recess (38*a*) so that the sliver ends overlap each other. The piecing operation is carried out on the overlapped sliver ends in a known manner.

2 Claims, 24 Drawing Sheets

AUTOMATIC PIECING OF OVERLAPPED LEADING AND TRAILING ENDS OF SLIVERS IN A TEXTILE MACHINE

BACKGROUND OF THE INVENTION

1. Field of the Invention

The present invention relates to an automatic sliver piecing in a textile machine such as a roving frame, a drawing frame or a carding engine.

2. Description of the Related Arts

Various automation systems have been adopted in a spinning mill in an effort to reduce labor and improve productivity, but sliver piecing, however, is still manually operated. This manual operation comprises the steps of overlapping a pair of sliver ends to be pieced, and rubbing the overlapped portion between the operator's palms. To obtain a pieced portion having a sufficient tensile strength and not causing a thickness unevenness in the resultant product, the silver piecing must be carefully carried out by a skilled operator. To facilitate this operation, Japanese Unexamined Patent Publication No. 62-97929 discloses an automatic sliver piecing by a device comprising a means for widening the width of an overlapped portion of sliver ends to form a flat sheet, and a means for rolling up the sheet from one edge thereof to form a bundle.

In the above publication, however, no means is proposed for automatically positioning the sliver ends to be pieced together at a predetermined area in a sliver piecing device.

SUMMARY OF THE INVENTION

Accordingly, an object of the present invention is to provide a method of positioning, in an overlapped manner, sliver ends to be pieced together in a predetermined area in a sliver piecing device by using a mechanism having a simple structure and able to be easily automated.

The above object of the present invention is achieved by a method of automatically positioning a trailing end of a first sliver in an exhaustion can and a leading end of a second sliver in a reserve can, in such a way that these ends overlap each other, in an operative zone of a piecing unit by means of a sliver gripper which is movable apart from and close to the sliver piecing unit and grips the sliver therein and releases the same therefrom, according to the present invention, comprising the steps of: displacing the sliver gripper close to the operative zone of the sliver piecing unit while holding a first sliver by the sliver gripper so that the first sliver is introduced into the operative zone of the sliver piecing unit; fixedly holding the first sliver in the operative zone; displacing the gripper apart from the sliver piecing unit while holding the first sliver in the operative zone, so that the first sliver is severed at the operative zone to form a trailing end of the first sliver; again displacing the sliver gripper close to the operative zone of the sliver piecing unit while holding a second sliver by the sliver gripper, so that the second sliver overlaps the trailing end of the first sliver held in the operative zone; fixedly holding the overlapped portion of the slivers in the operative zone; and again displacing the gripper apart from the sliver piecing unit while holding the second sliver in the operative zone, so that the second sliver is severed at the operative zone to form a leading end of the second sliver; whereby the trailing and leading ends of slivers to be pieced together are positioned in the operative zone of the sliver piecing unit in an overlapped manner for the preparation of the piecing operation of the sliver piecing unit.

In an alternative aspect of the present invention, the steps for the second sliver may be carried out prior to those for the first sliver.

BRIEF DESCRIPTION OF THE DRAWINGS

The present invention will be described in more detail with reference to the attached drawings illustrating the preferred embodiments, wherein:

FIG. 1 is a front view of a sliver piecing device for carrying out a method according to the present invention;

FIG. 2 is a side view of the sliver piecing device shown in FIG. 1;

FIG. 3 shows a layout of roving frames and rails;

FIG. 4 is a side view of the roving frames and rails shown in FIG. 3;

FIGS. 5(*a*) through 5(*h*) illustrate, respectively, a sequential step of the sliver piecing device;

FIG. 6(*a*) through 6(*f*) illustrate, respectively, a sequential step of a sliver intake arm and a sliver holding arm of a sliver piecing unit;

FIG. 7 illustrates a disposition of a leading portion of a sliver in a reserve can;

FIGS. 8(*a*) through 8(*h*) illustrate, respectively, another sequential step of a sliver piecing device;

FIG. 9 shows a layout of roving frames and rails;

FIG. 10 is a side view of the roving frames and rails shown in FIG. 3;

FIG. 11 is a perspective view of a sliver piecing device used in the second embodiment according to the present invention;

FIGS. 12(*a*) through 12(*k*) illustrate, respectively, a sequential step of a sliver piecing device shown in FIG. 11; and, FIGS. 13(*a*) through 13(*d*) illustrate, respectively, other sequential steps, each corresponding to those shown in FIGS. 12(*c*) through 12(*f*).

DESCRIPTION OF THE PREFERRED EMBODIMENTS

A first embodiment of the present invention will be described below with reference to FIGS. 1 through 8.

Figure 1:
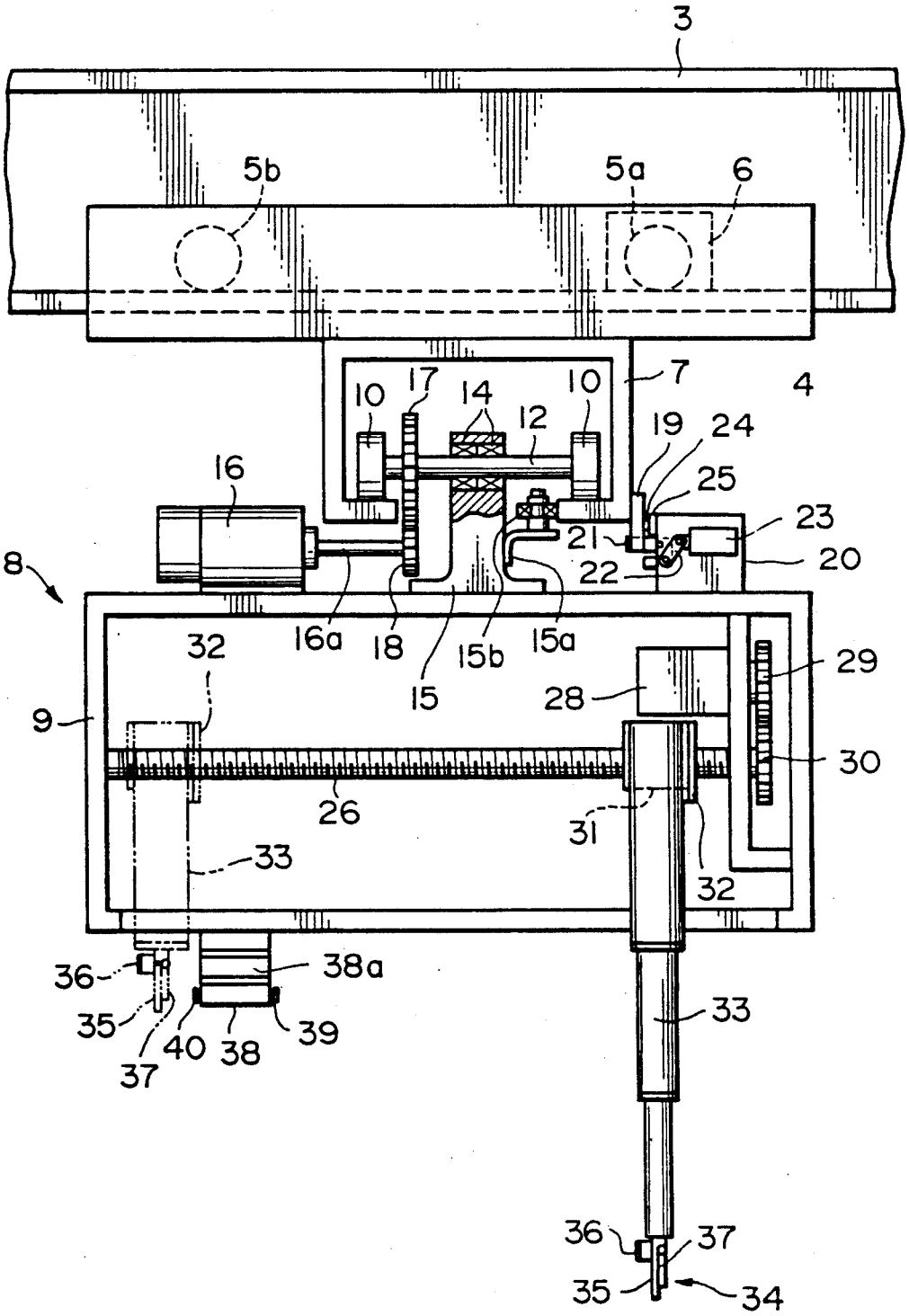
FIGS. 1 through 8 illustrate a first embodiment of the present invention.
Figure 3:
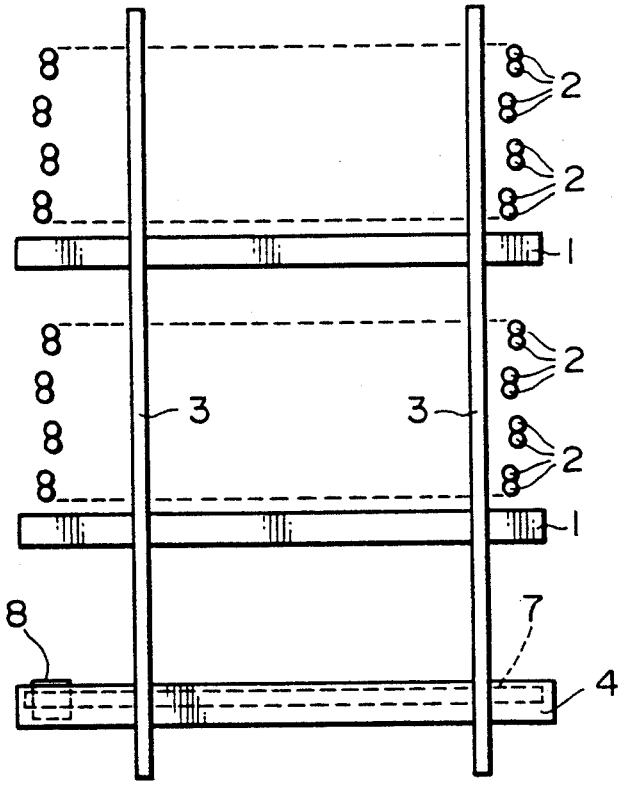
Figure 4:
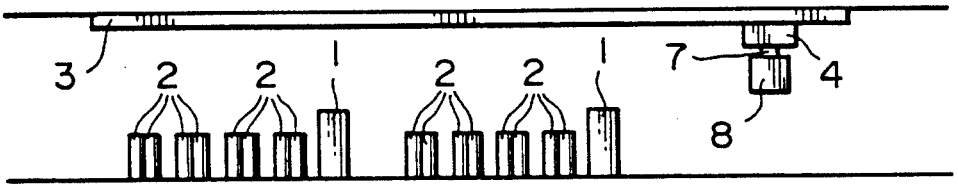
Figure 5A:
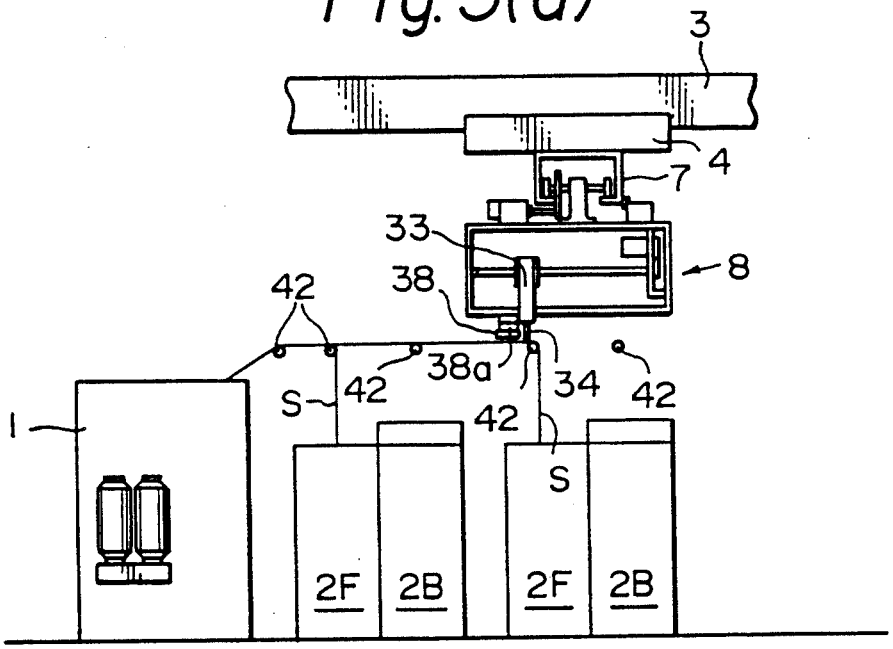
Figure 5B:
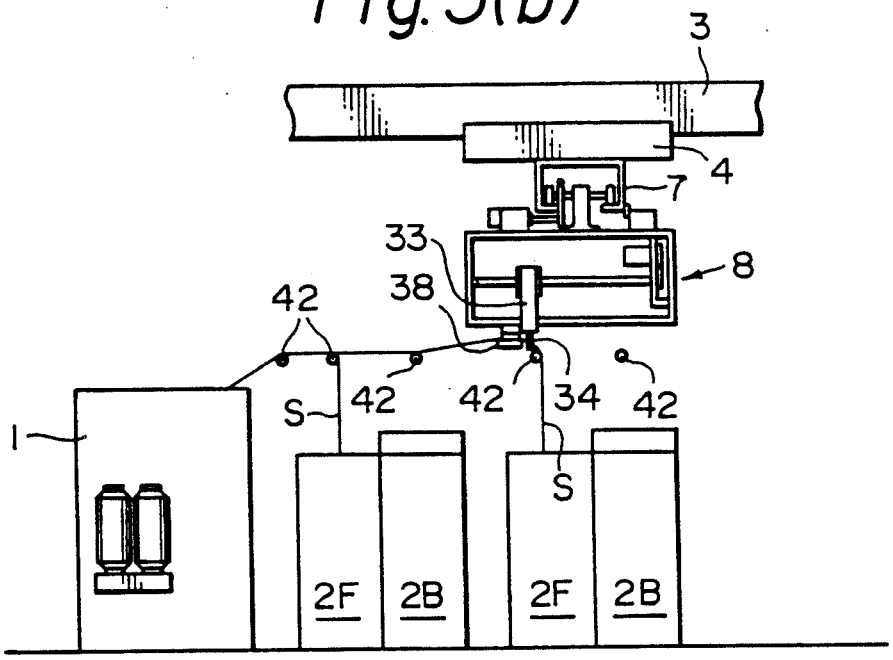
Figure 5C:
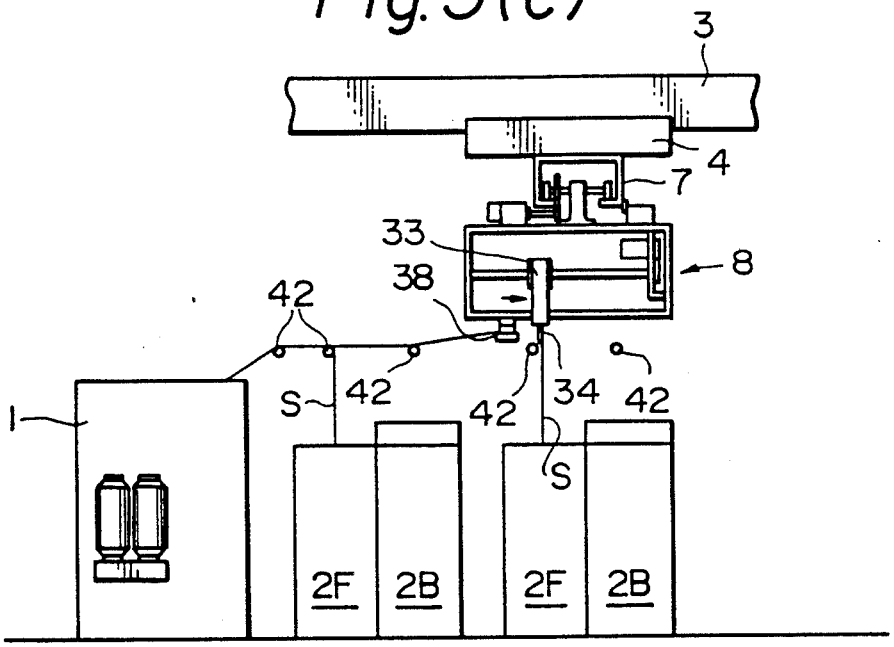
Figure 5D:
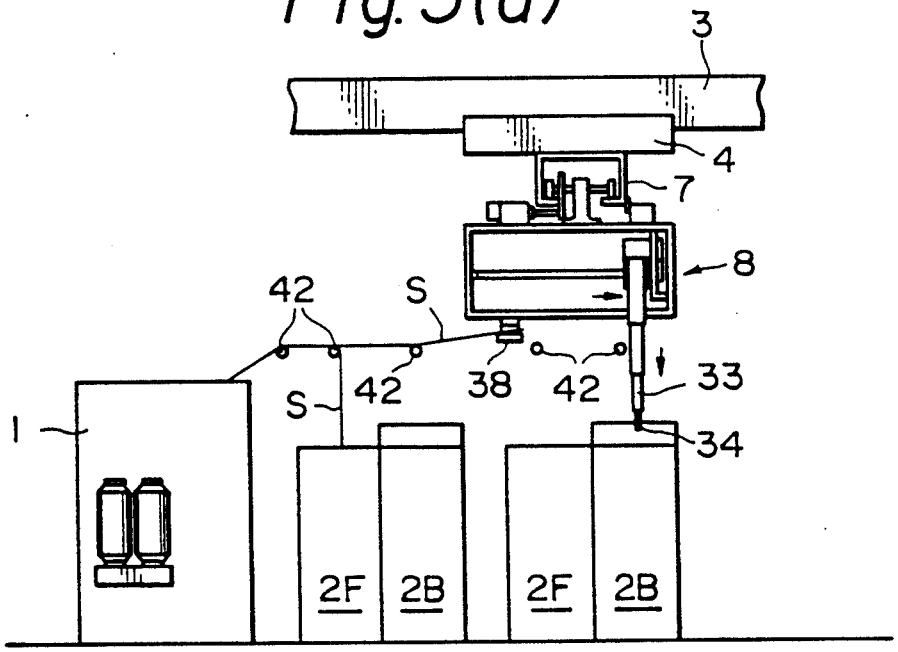
Figure 5E:
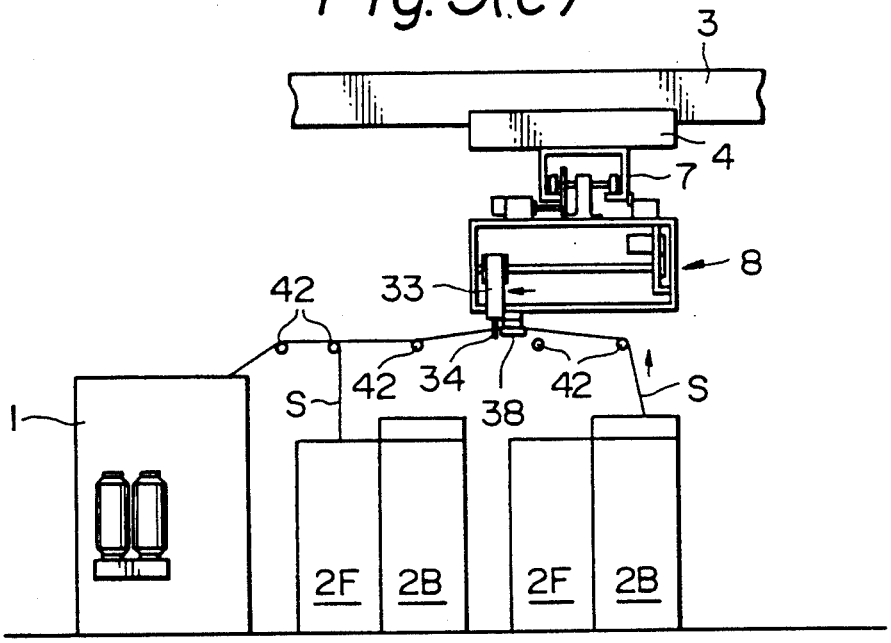
Figure 5F:
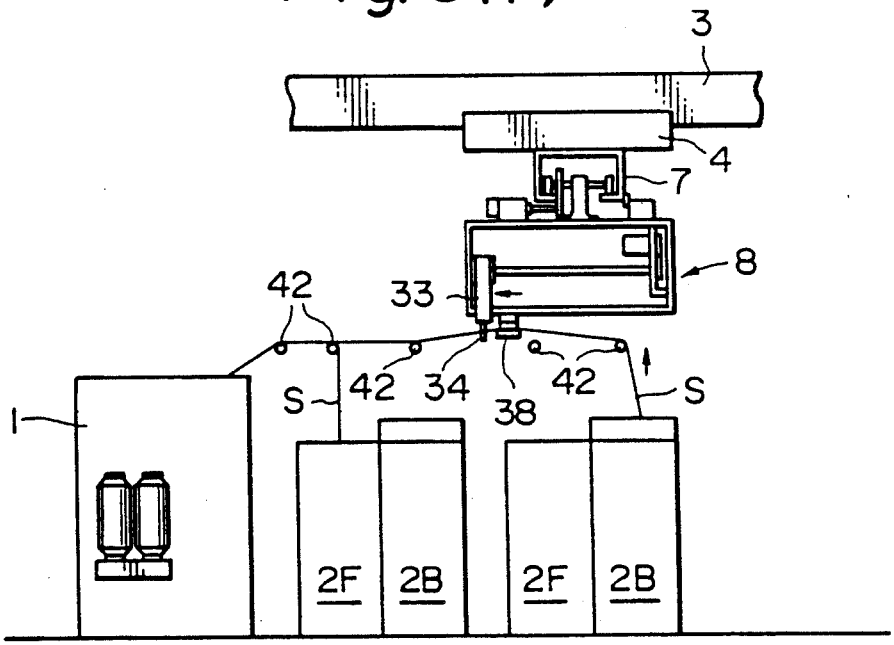
Figure 5G:
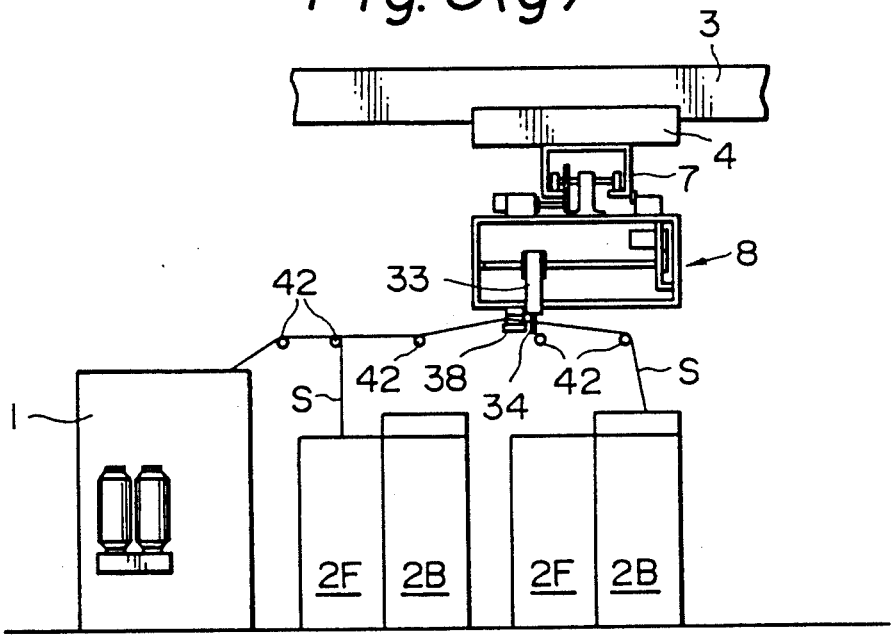
Figure 5H:
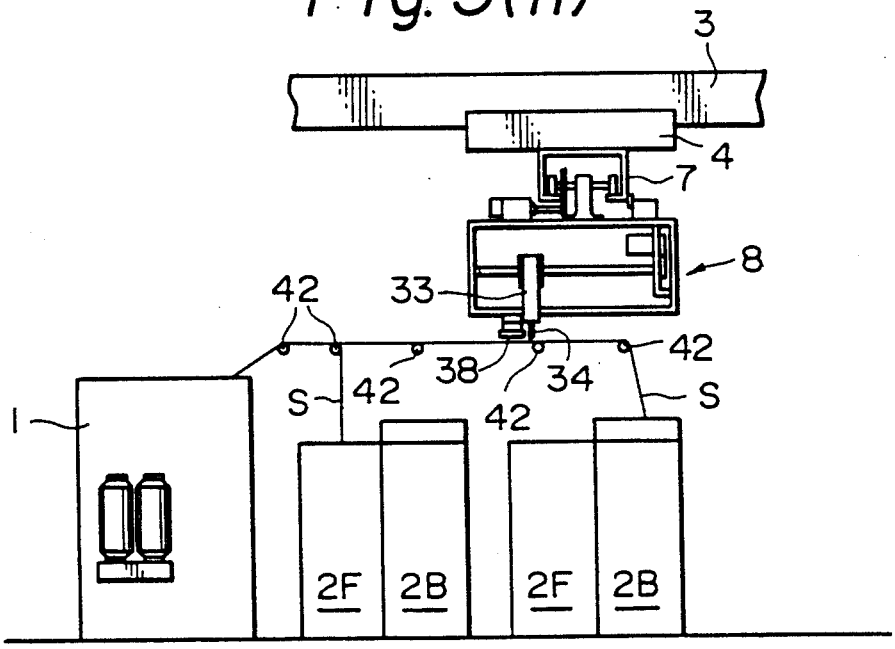
Figure 6A:
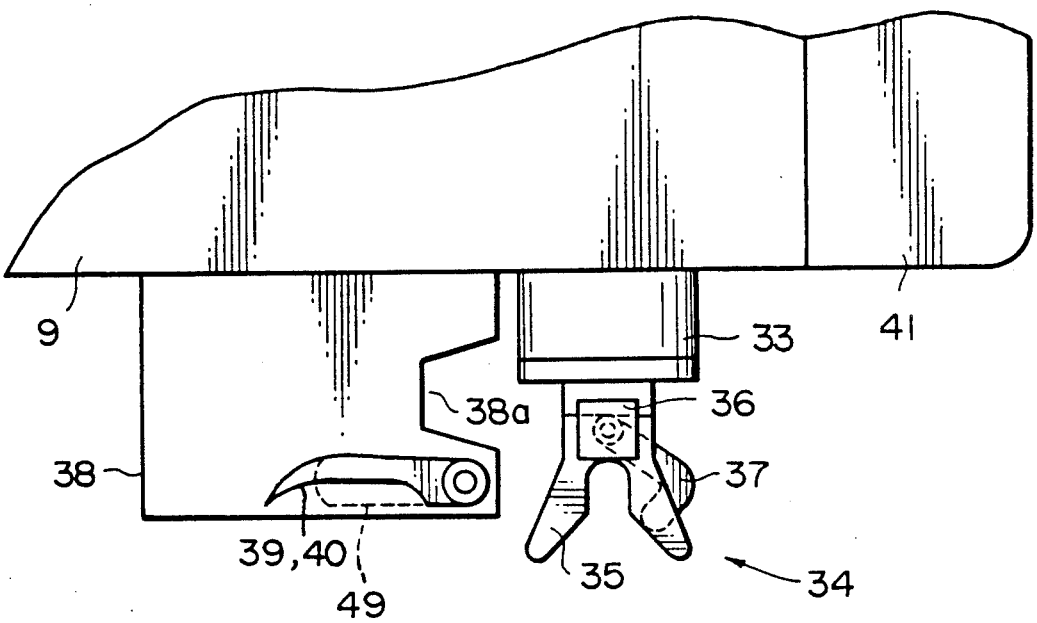
Figure 6B:
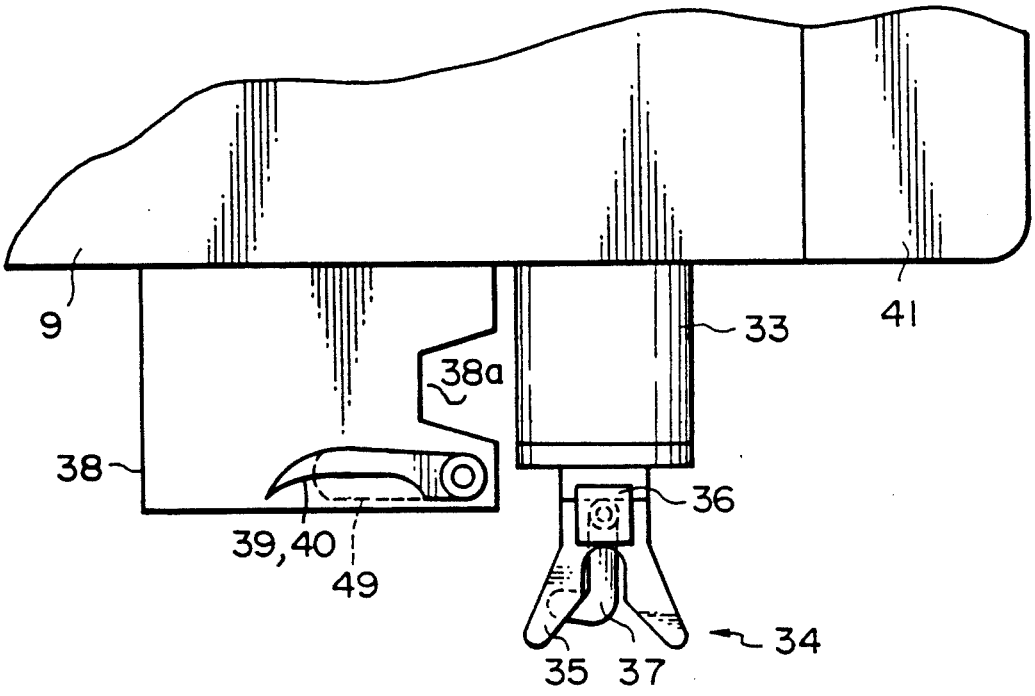
Figure 6C:
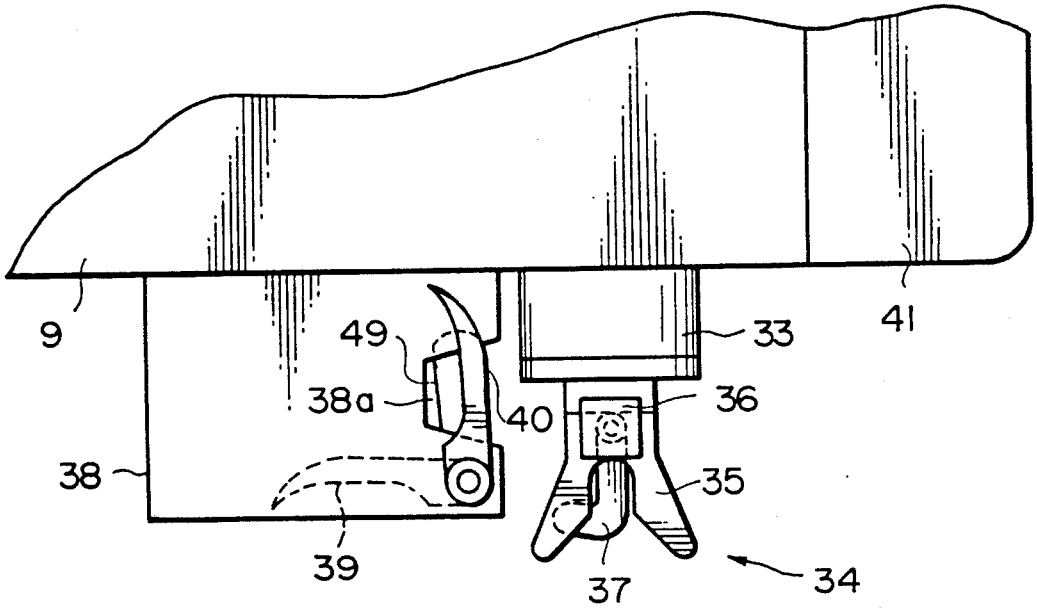
Figure 6D:
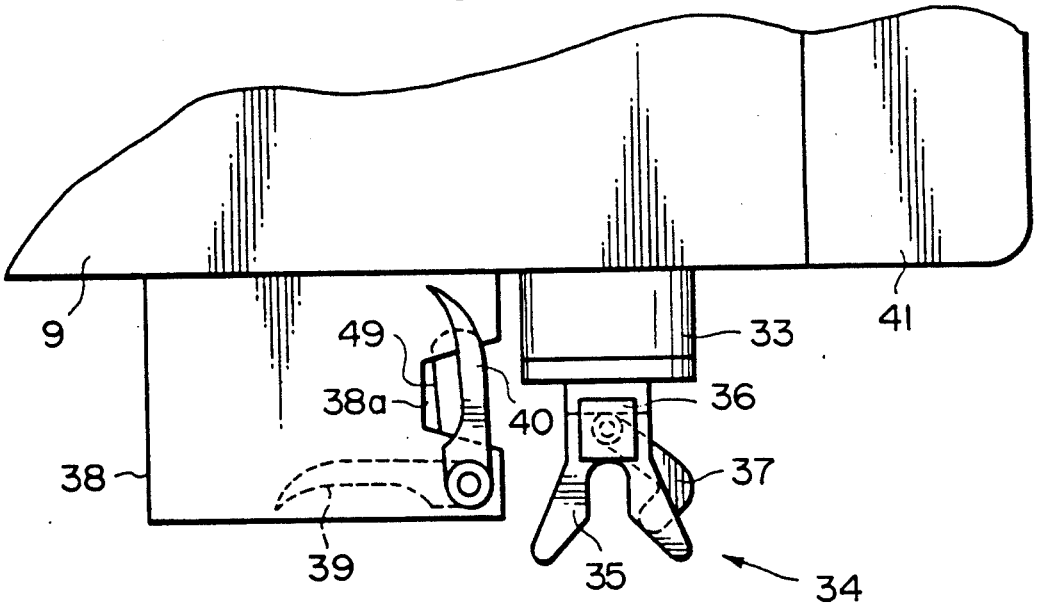
Figure 6E:
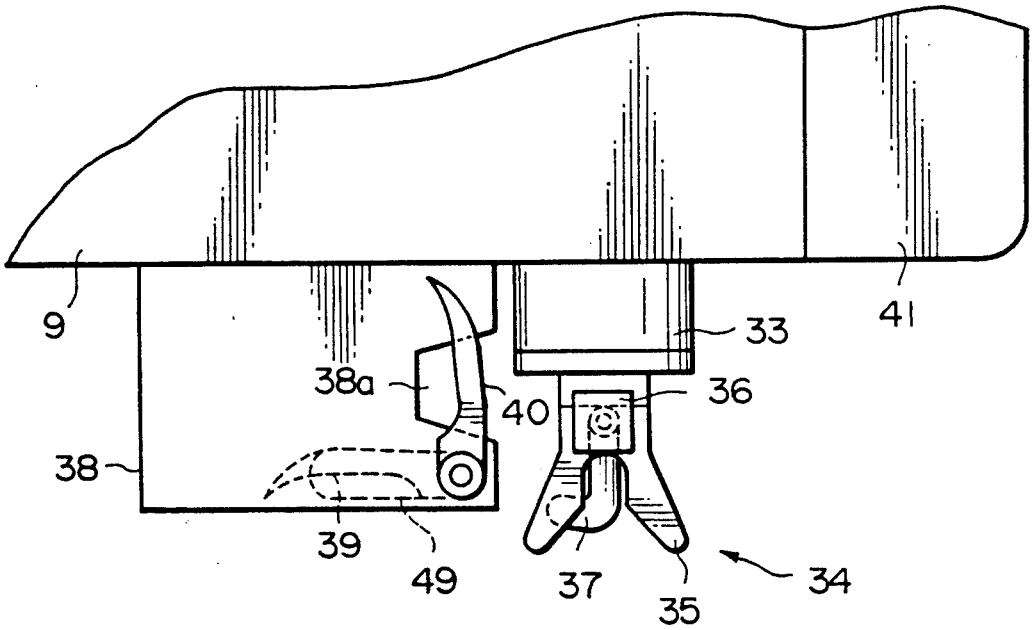
Figure 6F:
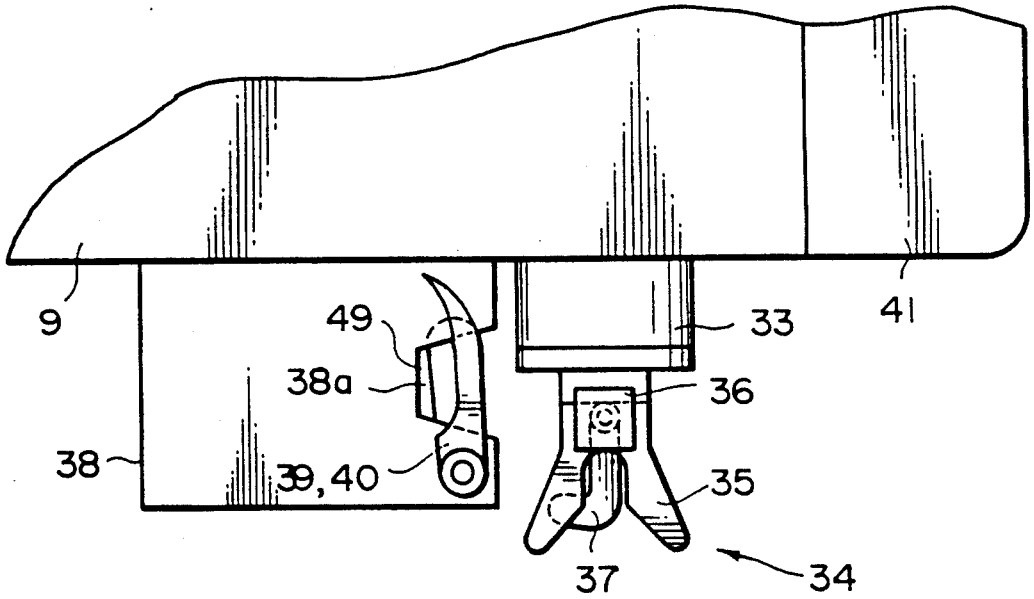

As shown in FIGS. 3 and 4, plurality of rows of cans are arranged in parallel to each other behind the respective roving frame 1, and a sliver is fed to the roving frame from the can 2. A pair of rails 3 for supporting a crane 4 extend above the group of roving frames 1 transversely to the lengthwise direction of roving frame 1. As shown in FIG. 1, the crane 4 is suspended from the rails 3 by a drive roller 5*a* and a driven roller 5*b* to be displaceable transversely to the roving frame 1 by a normal and reverse rotation of a motor 6. On the underside of the crane 4 is mounted a movable rail 7 having a length substantially equal to that of the roving frame 1.

An automatic sliver piecing device 8 is provided on the movable rail 7 and displaceable therealong during the sliver positioning operation.

Figure 2:
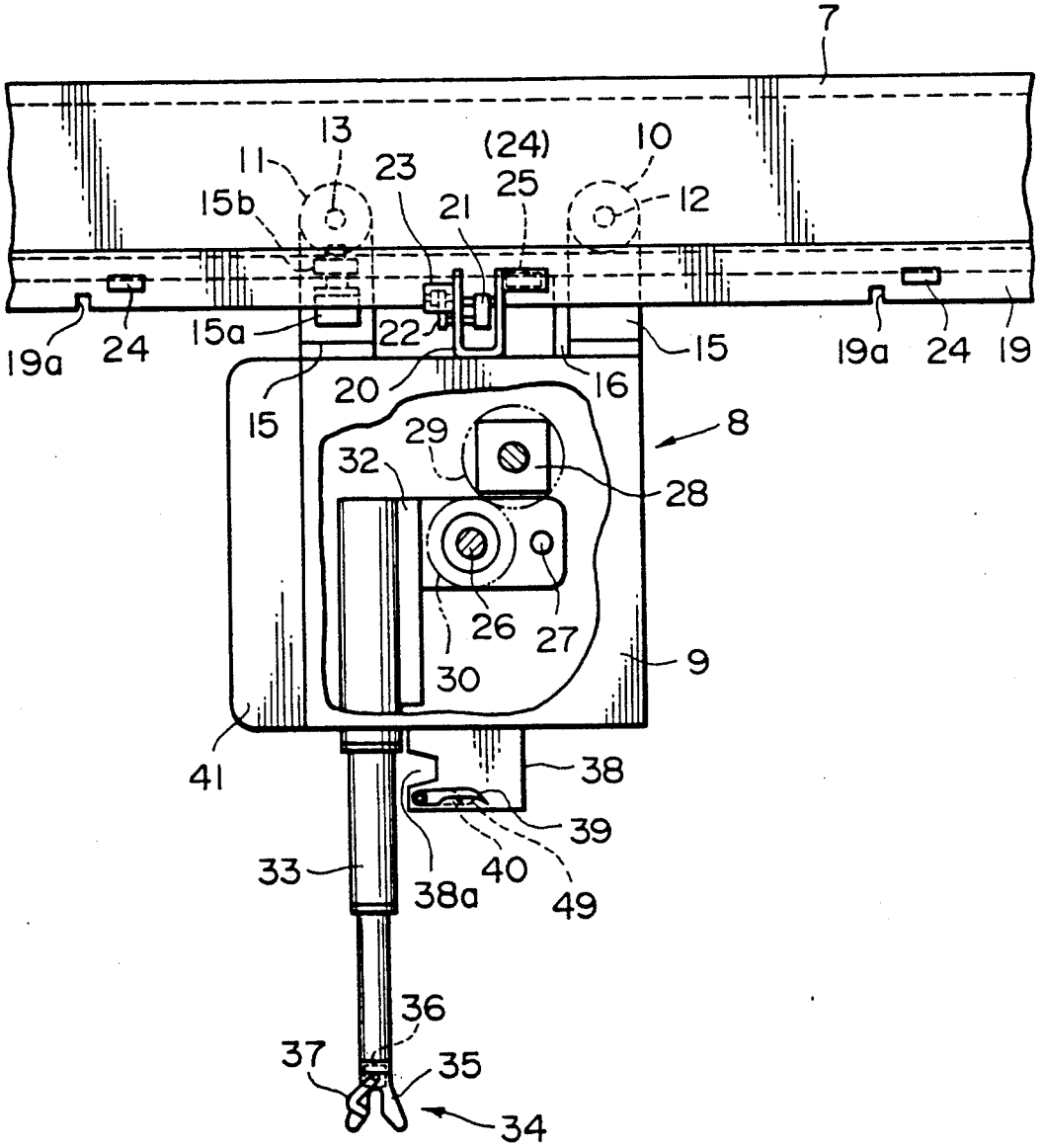

The sliver piecing device 8 comprises, as shown in FIGS. 1 and 2, a box-like housing 9 suspendingly held by shafts 12 and 13 through bearings 14 secured on brackets 15. The shaft 12 has a pair of drive rollers 10 and the shaft 13 has a pair of driven rollers 11 fixed at the opposite ends thereof, respectively. On each side of the bracket 15, a bearing 15*b* is secured through a support 15*a* for defining the lateral position of the sliver piecing device 8 (only one bearing is shown in the drawing). A motor 16 is mounted on the upperside of the housing 9, and a gear 18 is fixed on a driving shaft 16*a* of the motor 16 and intermeshed with a gear 17 fixed on the shaft 12, whereby the sliver piecing device 8 is movable along the movable rail 7 by the normal and reverse rotation of the motor 16. A positioning plate 19 is fixed on the lower portion of the outside of the movable rail 7 and provided with a plurality of notches 19*a* arranged at a pitch corresponding with that of bobbin wheels on the roving frame. On the contrary, a bracket 20 having a U-shaped cross-section is fixed on the upperside of the housing 9 to confront the outside of the positioning plate 19. An engagement lever 21 is rotatably held on the bracket 20 at one end so that the other end crosses the positioning plate 19 and is coupled to a plunger of a solenoid 23 through a link 22. The engagement lever 21 is biased to be rotated by a spring (not shown), to occupy a position engageable with the notch 19*a*. Conversely, if the solenoid 23 is operated, the lever 21 occupies a retracted position disengaged from the notch 19*a*. The bracket 20 has a proximity switch 25 for detecting the respective detection pieces 24 arranged on the positioning plate 19 at a pitch in the vicinity of the notch 19*a*.

A screw shaft 26 constituting a part of a ball and screw mechanism is rotatably held in the housing 9 while extending transverse to the movable rail 7. A guide rod 27 (see FIG. 2) extends in parallel to the shaft 26. The screw shaft 26 has a gear 30 at one end, which is intermeshed with a gear 29 fixed to a drive shaft of a motor 28. A movable bracket 32 having a ball nut 31 is secured on the screw shaft 26 and the guide rod 27 and is displaceable therealong by the rotation of the shaft 26. A boom 33 is fixed to the movable bracket 32, which is extendable and retractable in the vertical direction due to a hydrostatic or aerostatic action, and a gripper 34 is secured on the tip of the boom 33 for gripping the sliver S, and comprises a fork-like stationary gripping piece 35 and a movable piece 37 driven by a rotary solenoid 36 fixed to a base of the stationary piece 35.

A sliver piecing unit 38 is fixedly secured to the underside of the housing 9, the structure of which is identical to that disclosed in Japanese Unexamined Patent Publication No. 62-97929. The sliver piecing unit 38 is disposed so that a sliver introduction recess 38*a* thereof confronts a traverse path of the boom 33. A sliver intake arm 39 and a sliver holding arm 40 are secured on opposite sides of the sliver piecing unit 38, and the arms 39, 40 are driven by a reversible motor (not shown) secured on a pivot of the arm to occupy either a retracted position illustrated in FIG. 2 or an operative position clockwisely apart from the former by 270°. A group of sliver pressers 49 rotatable integrally with each other about a common pivot by a drive means similar to that stated above are provided on a section of the sliver piecing unit 38 between the arms 39 and 40. The sliver holding arm 40 is arranged to occupy a position closer to the roving frame 1 (leftside in FIG. 1) when the sliver piecing unit 38 is set in the operative position as shown in FIGS. 5 and 8. Both arms 39, 40 have the same length, which is sufficient to engage the sliver gripped by the gripper 34 when the boom occupies the retracted position as shown in FIG. 6(*c*). To control the operation of the motors 16 and 28 and solenoids 23 and 36, and to communicate with a central processing unit (not shown) for supervising the total system, a control box 41 is provided in the housing 9.

The operation of the above apparatus will be described below.

Figure 7:
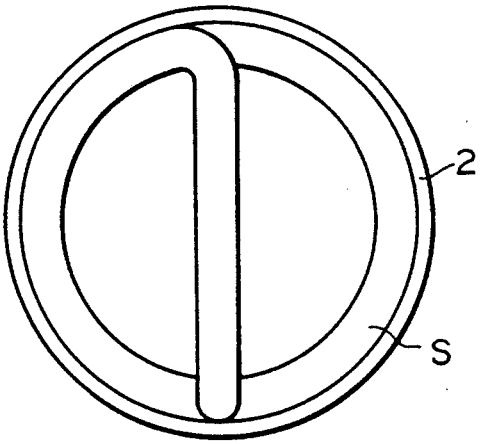

As shown in FIG. 3, the crane 4 is in a standby position, and the roving frame 1 are in operation while being controlled so that a bobbin exchange does not simultaneously occur in a group of frames. In this regard, the sliver piecing is usually carried out subsequent to or simultaneously with the bobbin exchange A short time before the bobbins on the roving frame 1 become full, a precaution signal for a full bobbin is issued from the roving frame 1 to the central processing unit, which then identifies the roving frame on which the sliver piecing is to be carried out and issues a signal to the crane 4 to move to the operation area corresponding to the identified roving frame 1. According to this signal, the crane 4 moves to a position corresponding to a row of cans at which the sliver piecing operation is needed. After the bobbins are full, the roving frame 1 is stopped and a signal is issued to the sliver piecing device 8, whereby the motor 16 rotates normally so that the sliver piecing device 8 is displaced along the movable rail 7. The control box 41 issues a stop signal to the motor 16 when the proximity switch 25 sequentially detects the predetermined number of the detection pieces 24, whereby the motor 16 is stopped but the sliver piecing device 8 is still moving slowly due to its own inertia along the rail 7. Simultaneously, the solenoid 23 is energized to forcibly rotate the engagement lever 21 to an operative position. This movement of the lever 21, however, is restricted due to the contact thereof with the underside of the positioning plate 19, whereby the lever 21 moves while sliding over the underside of the plate 19. When the sliver piecing device 8 moves to a position in which the lever 21 coincides with the notch 19*a*, the lever is engaged with the notch 19*a* whereby the sliver piecing device 8 is completely stopped to occupy a predetermined position for carrying out the sliver piecing operation. The piecing steps are as follows:

As shown in FIG. 5(*a*), a can 2F now feeding a first sliver to the roving frame 1 (hereinafter referred to as "exhaustion can") and a reserve can 2B are disposed beneath a guide roller 42 for delivering the sliver to a draft part of the roving frame. Each can 2F or 2B forms two parallel rows, respectively, along the lengthwise of the roving frame. A second sliver S in the reserve can has a leading portion disposed diametrically transverse to the open top of the can and extending in parallel to the roving frame as shown in FIG. 7. The sliver S continuing from the exhaustion can 2F to the roving frame 1 through the guide roller 42, as shown in FIG. 5(*a*), is extended in parallel to the wall of the sliver introduction recess 38*a* in the area beneath the sliver piecing unit 38. The boom 33 is slightly elongated downward so that the first sliver S is introduced into a cavity formed in the stationary gripping piece 35. Then the rotary solenoid 36 operates to rotate the movable gripping piece 37 to the operative position, as shown in FIG. 6(*b*), so that the first sliver S is gripped by both gripping pieces 35 and 37. Thereafter, the boom 33 is retracted to the original position to locate the first sliver S in the vicinity of the sliver introduction recess 38*a*. The sliver holding arm 40 is rotated counterclockwise from the position shown in FIG. 6(*b*) to take-in the first sliver S in the recess 38*a*, and thus the first sliver S is held by the arm 40 as shown in FIG. 5(*b*). Next, the sliver pressers 49 are rotated to confront the recess 38*a* (see FIG. 6(*c*)), and then the motor 28 is normally driven to displace, along the screw shaft 26, the boom 33 apart from the sliver piecing unit 38 while holding the first sliver S therein. During this displacement, the first sliver S is severed as shown in FIG. 5(*c*) because the first sliver is held in the recess 38*a* by the action of the sliver holding arm 40 and the pressers 49*a*. That is, during the severing operation, the first sliver S is torn so that fibers forming the sliver body are partly pulled away from the remainder and a trailing end held in the recess 38*a* is formed on the sliver portion merging in the roving frame 1. The rotary solenoid 36 is operated after the completion of the sliver severing to rotate the movable gripping piece 37 to the release position as shown in FIG. 6(*d*), so that the sliver waste severed from the trailing end is dropped in the can 2F. the boom 33 then moves to just above a center of the reserve can 2B at which the leading portion of the second sliver S is waiting and the motor 28 is stopped.

The boom 33 extends downward, as shown in FIG. 5(*d*), so that the gripper 34 is engageable with the leading portion of the second sliver S in the reserve can 2B. In this position, the leading portion of the second sliver S is naturally introduced into the cavity in the stationary gripping piece 35. Due to the action of the rotary solenoid 36, the movable gripping piece 37 holds the second sliver S in cooperation with the stationary gripping piece 35. The boom 33 is retracted to withdraw the second sliver S from the can 2B and raise the same above the guide roller 42, and after the gripper 34 moves upward to the predetermined position, the motor 28 is made to reversely rotate so that the boom 33 moves laterally together with the bracket 32 apart from the sliver piecing unit 38 toward the roving frame 1. During this displacement, the leading portion of the second sliver S now held by the gripper 34 is conveyed to a position confronting the recess 38*a* of the sliver piecing unit 38, as shown in FIG. 5(*e*). Prior to the displacement of the boom 33, the sliver presser 49 is rotated from the position shown in FIG. 6(*d*) to the retracted position shown in FIG. 6(*e*).

When the leading end of the second sliver S accommodated in the reserve can 2B is disposed to confront the recess 38*a* in FIG. 5(*e*), the sliver intake arm 39 and the sliver pressers 49 are rotated counterclockwise to change the position thereof from that shown in FIG. 6(*e*) to that shown in FIG. 6(*f*), whereby the second sliver S held by the gripper 34 is introduced into the recess 38*a*. Next, the motor 28 is made to reversely rotate to displace the boom 33 apart from the sliver piecing unit 38 in the lateral direction so that part of the fibers forming the second sliver S held in the gripper 34 are pulled away from the remainder at the recess 38*a* to form a leading end of the second sliver S the recess 38*a*. As a result, the trailing end of the first sliver and the leading end of the second sliver overlap each other in the recess 38*a*.

The sliver intake arm 39 and the sliver holding arm 40 are rotated clockwise to release the sliver ends so that the sliver piecing unit 38 can carry out the piecing operation on the sliver ends. During the piecing operation, the boom 33 is displaced laterally apart from the roving frame 1 by the normal rotation of the motor 28 to a position corresponding to that of the first can 2F now vacant. Then the rotary solenoid 36 operates to move the movable gripping piece 37 to the releasing position, whereby a sliver waste severed from the second sliver is dropped into the first can 2F before the boom 33 returns to the original position. When the piecing steps made by the sliver piecing unit 38 have been completed, the pressers 49 are rotated clockwise to occupy the position shown in FIG. 6(*a*) and the second sliver now pieced with the first one is disposed in the proper path reaching the roving frame 1 through the guide roller 42, as shown in FIG. 5(*h*).

The solenoid 23 is deenergized after the sliver is released from the sliver piecing device 8, and the engagement lever 21 returned to the retracted position at which it is disengaged from the notch 19*a*. Simultaneously, the motor 16 is rotated to move the sliver piecing device 8 to another area where the next piecing operation is to be carried out. The above-described piecing steps are sequentially repeated until all pairs of cans needing the sliver piecing have been subjected to the piecing operation. Thereafter, the sliver piecing device 8 is returned along the movable rail 7 to the retracted position and the crane 4 moved along the rails 3 to the standby position, by the action of the motor 6, and stopped there.

The above description is made of the case in which the first can from which a sliver is laid on the spinning path is closer to the roving frame 1 than the second (reserve) can, but even if the position of the respective cans are reversed, the movements of the gripper 34, the sliver intake arm 39 and the sliver holding arm 40 are identical to those in FIGS. 5(*a*) through 5(*h*) and 6(*a*) through 6(*f*), except for the lateral displacements of the boom 33. That is, after the crane 4 is stopped at a position corresponding to the rows of cans requiring the piecing operation, as shown in FIG. 8(*a*), the first sliver S in the can 2B is introduced into the recess 38*a* of the sliver piecing unit 38. Then the first sliver S is severed by the displacement of the boom 33 as shown in FIG. 8(*b*) while the trailing end thereof is held in the recess 38*a*. The sliver S is released from the gripper 34 after the opposite end of the sliver S held by the gripper 34 reaches a position just above the can 2B, as shown in FIG. 8(*c*). Next, the second sliver S is withdrawn from the can 2F as shown in FIG. 8(*d*) and conveyed to a position corresponding to the recess 38(*a*) of the sliver piecing unit 38 as shown in FIG. 8(*e*). Then the sliver intake arm 39 is operated so that the second sliver S is introduced into the recess 38*a*, and thereafter, the sliver S is severed by the lateral displacement of the gripper 34 toward the roving frame 1 as shown in FIG. 8(*f*) so that the leading end of the second sliver is formed. The gripper 34 is then displaced to a position just above the can 2B and releases a sliver waste into the can 2B as shown in FIG. 8(*g*), and finally, the gripper 34 is returned to the waiting position as shown in FIG. 8(*h*).

Another embodiment of the present invention will be described below, with reference to FIGS. 9 through 13.

Figure 9:
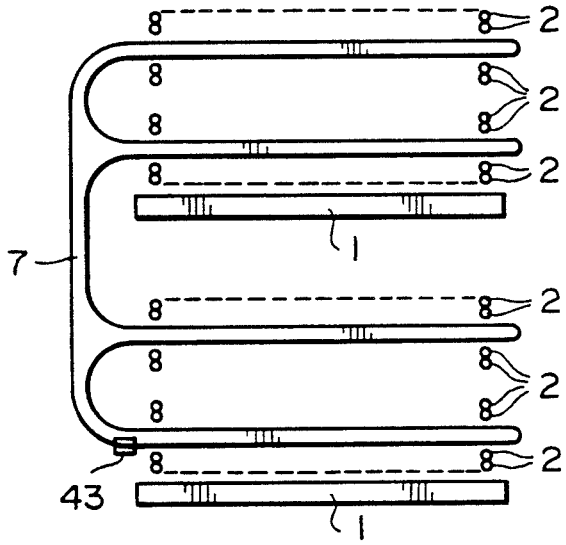
FIGS. 9 through 13 illustrate a second embodiment of the present invention.
Figure 10:
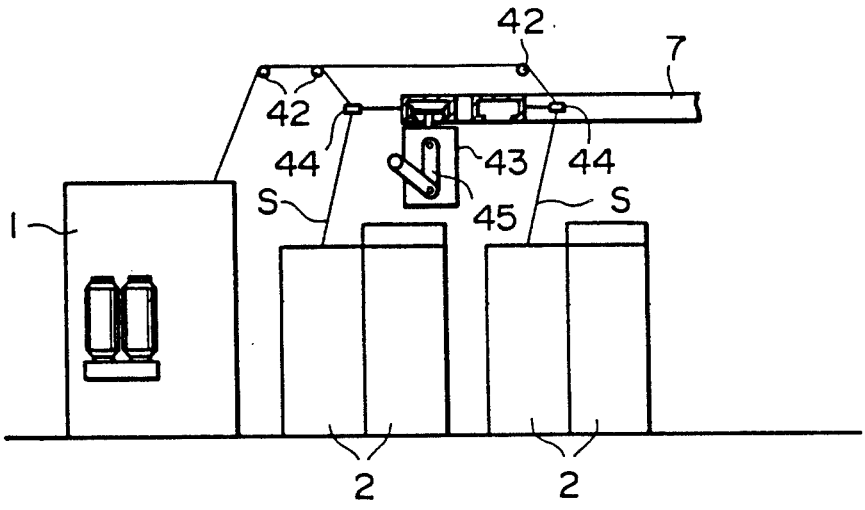
Figure 8A:
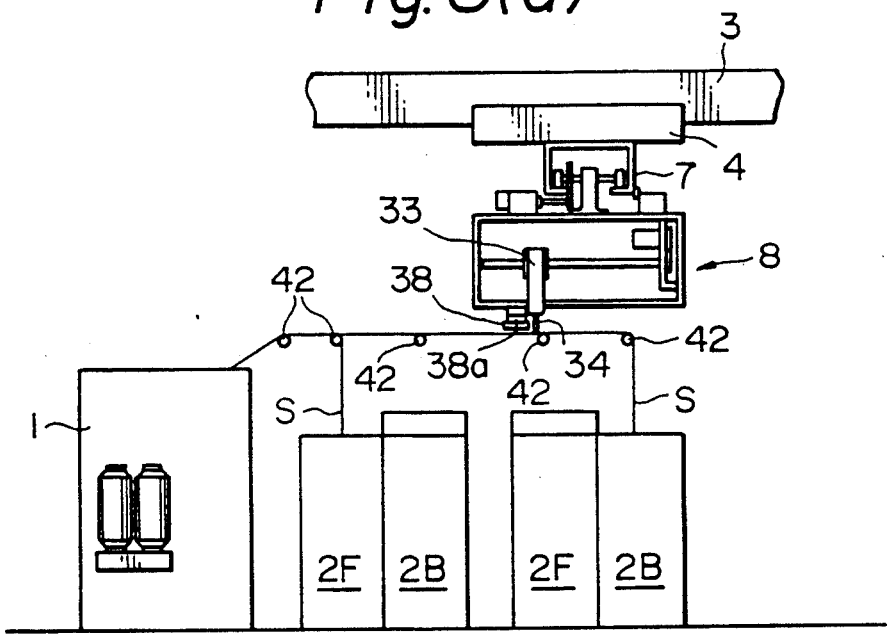
Figure 8B:
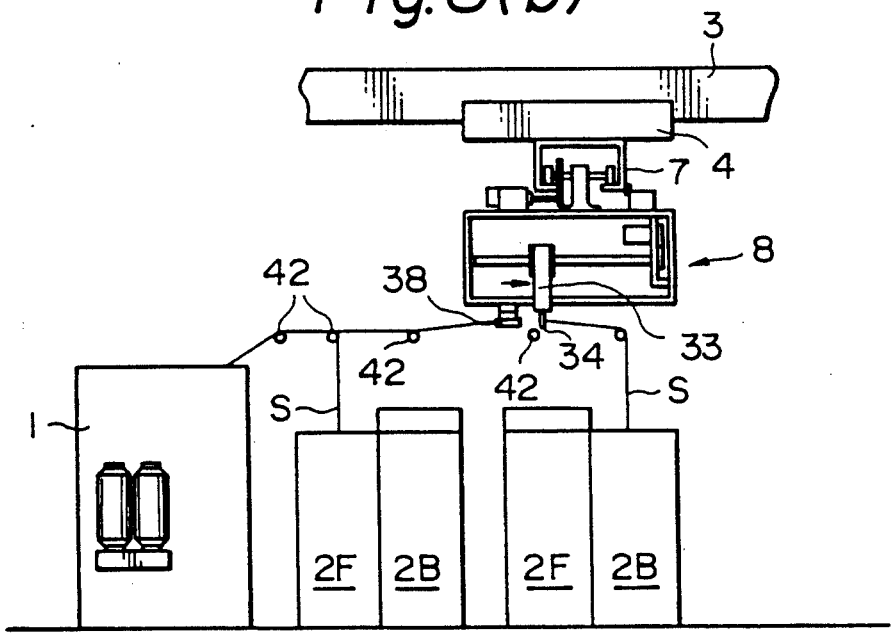
Figure 8C:
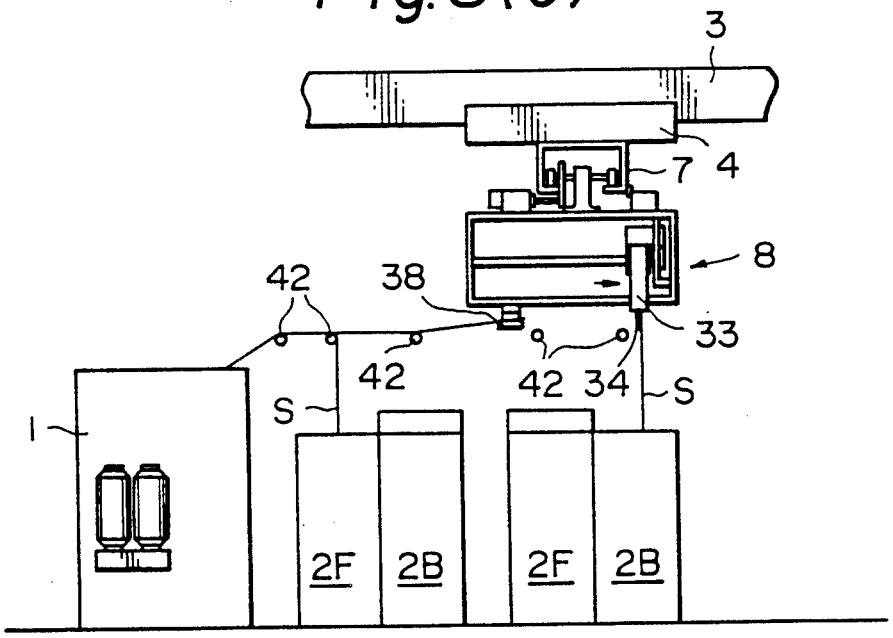
Figure 8D:
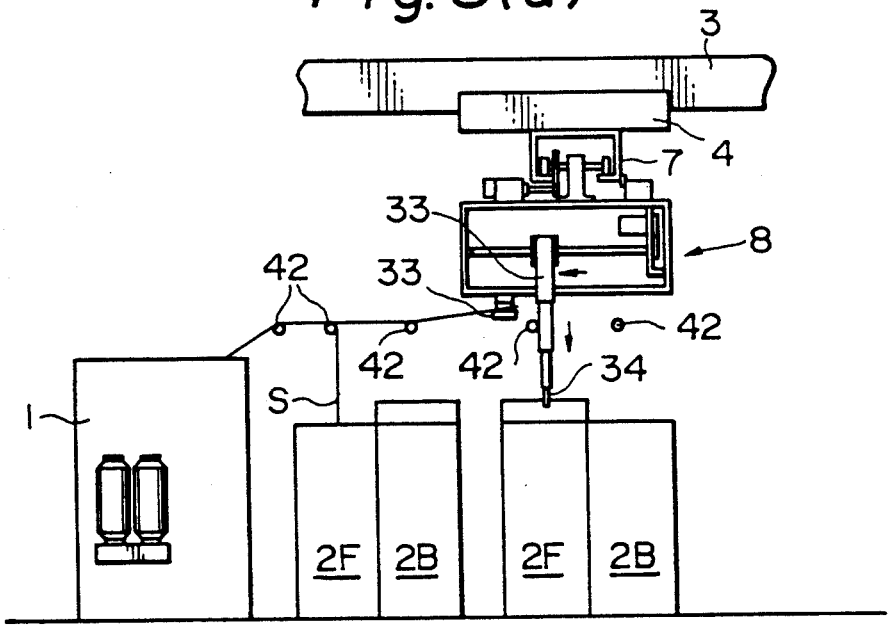
Figure 8E:
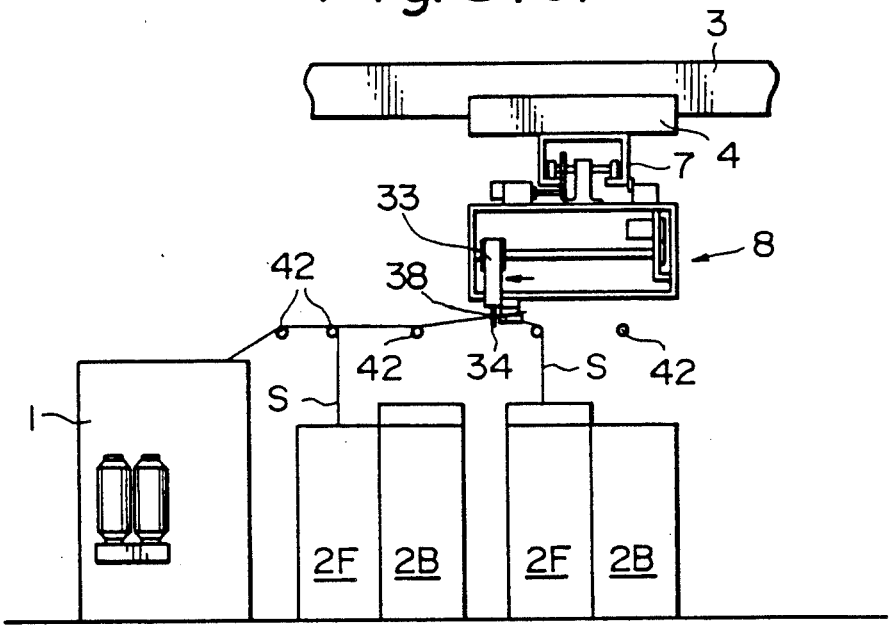
Figure 8F:
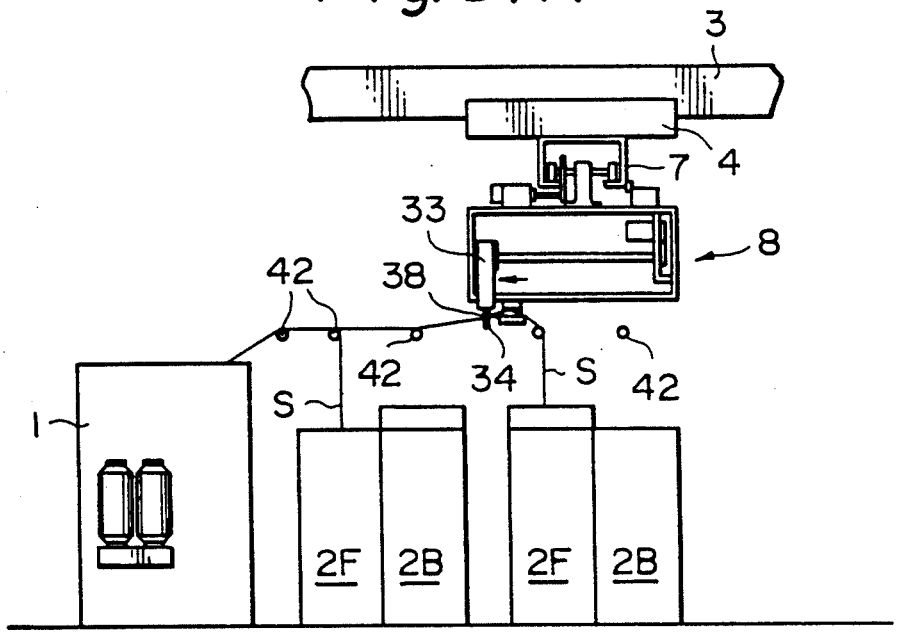
Figure 8G:
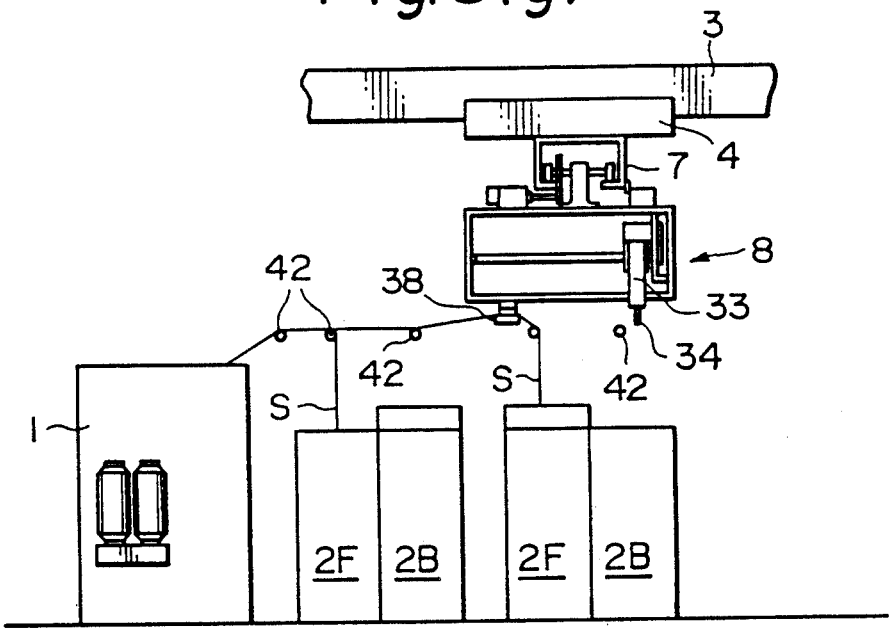
Figure 8H:
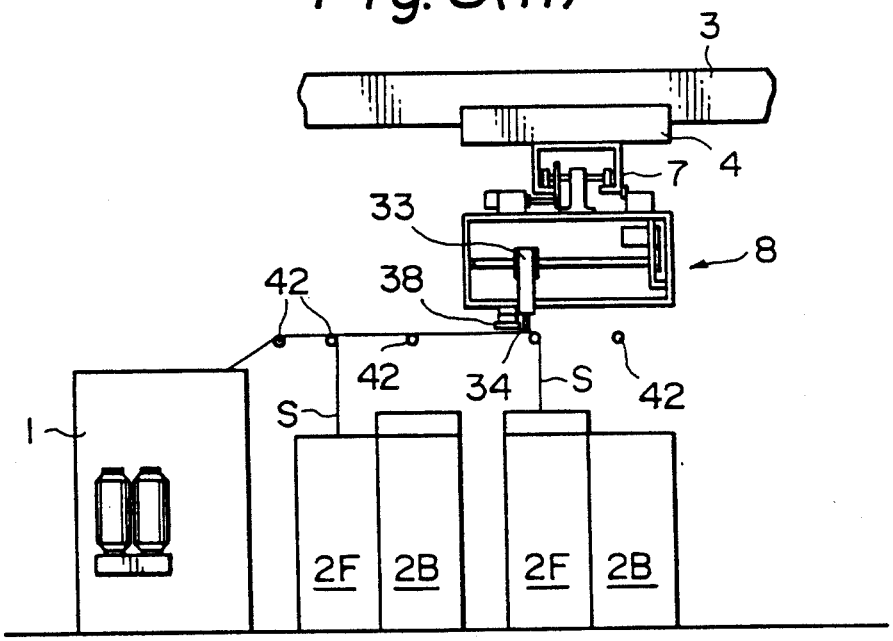
Figure 11:
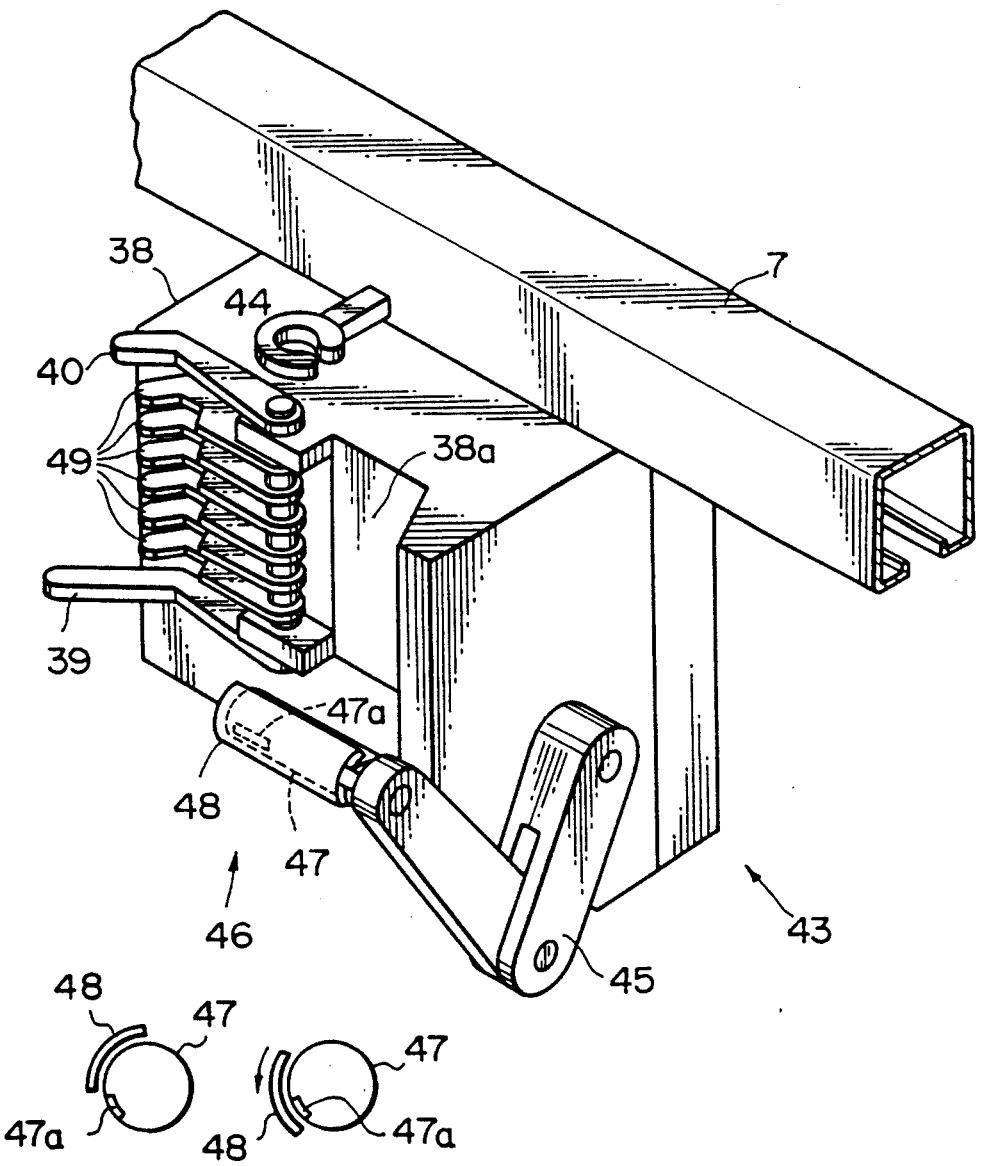
Figure 12A:
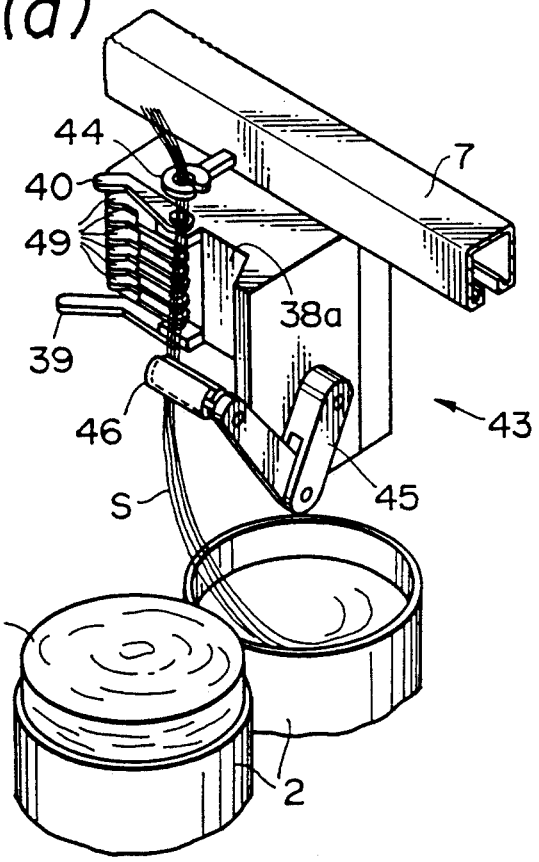
Figure 12B:
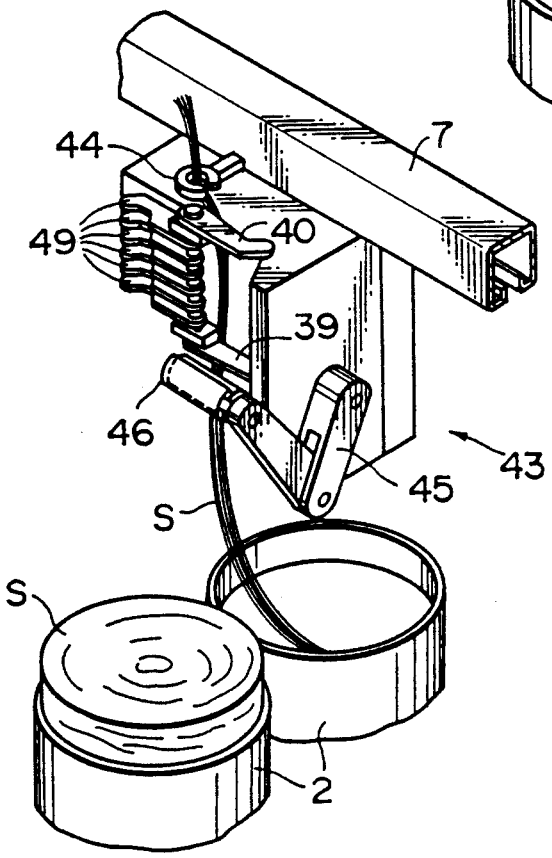
Figure 12C:
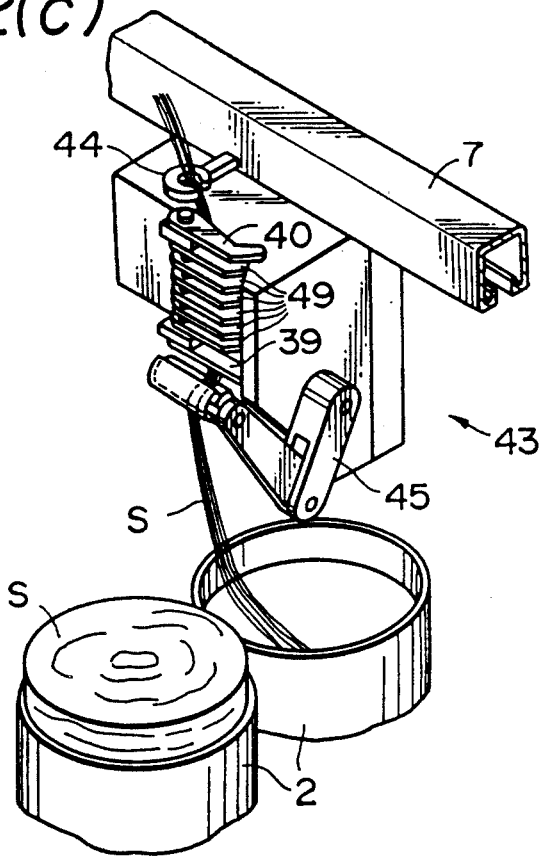
Figure 12D:
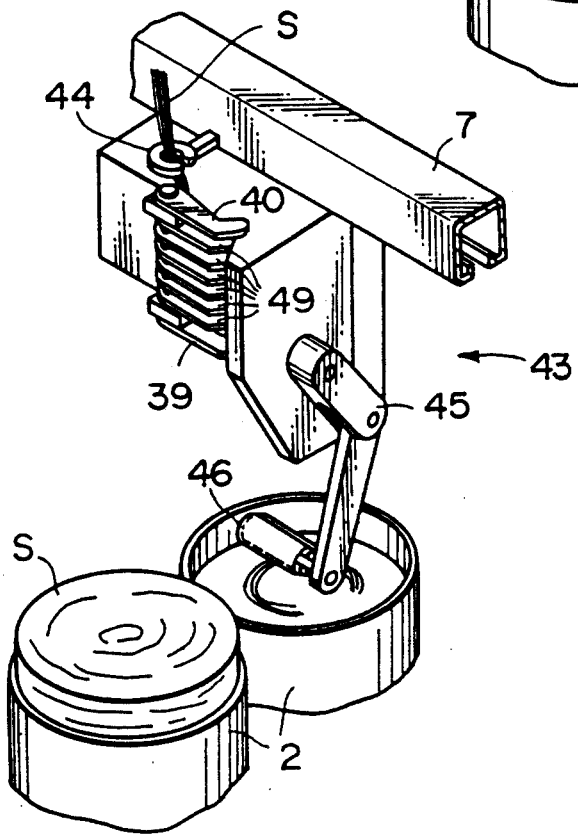
Figure 12E:
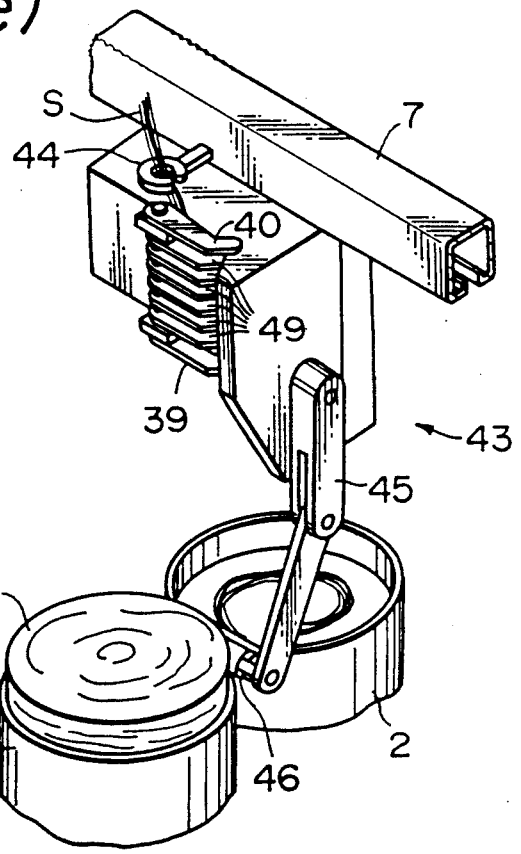
Figure 12F:
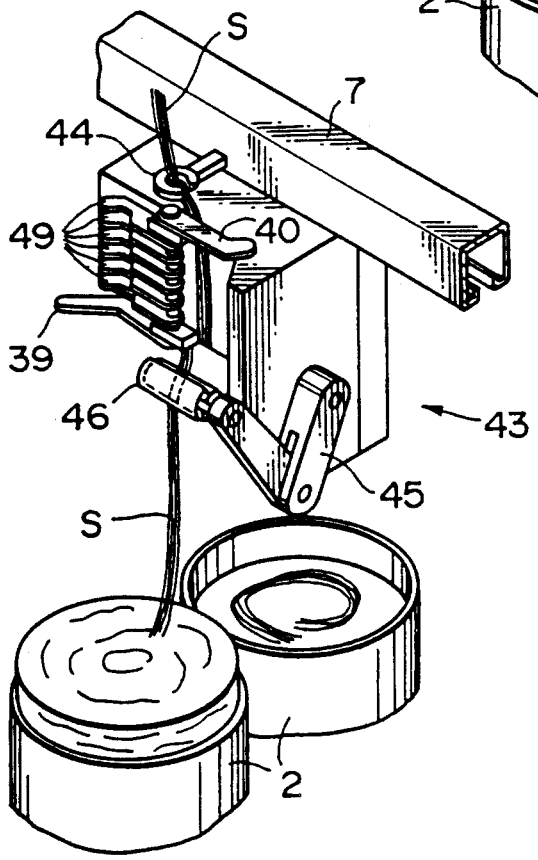
Figure 12G:
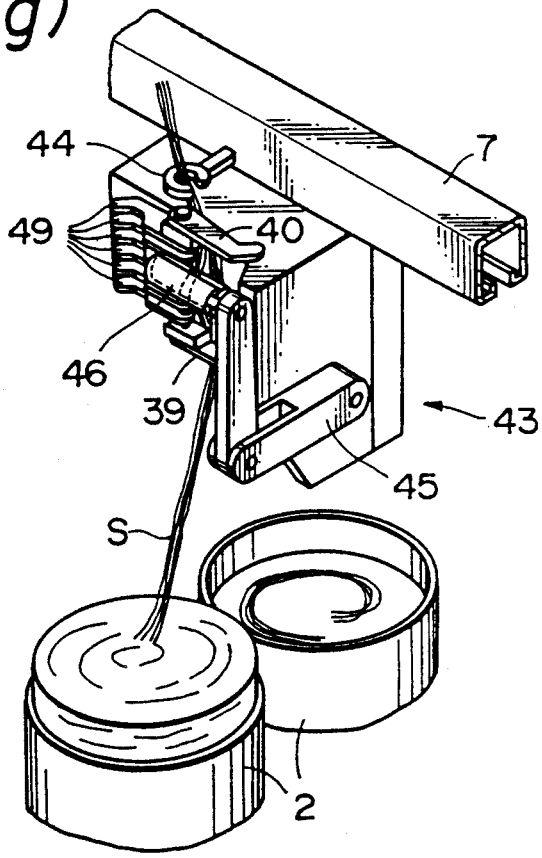
Figure 12H:
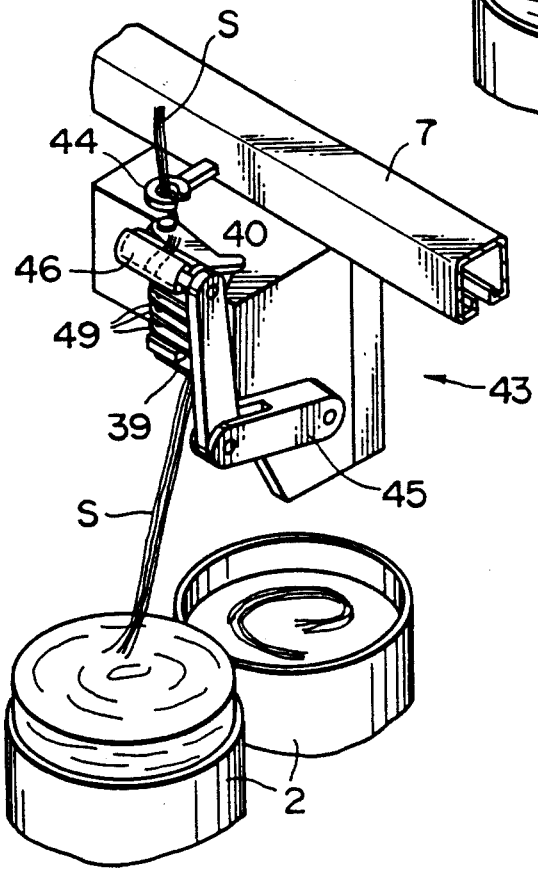
Figure 12I:
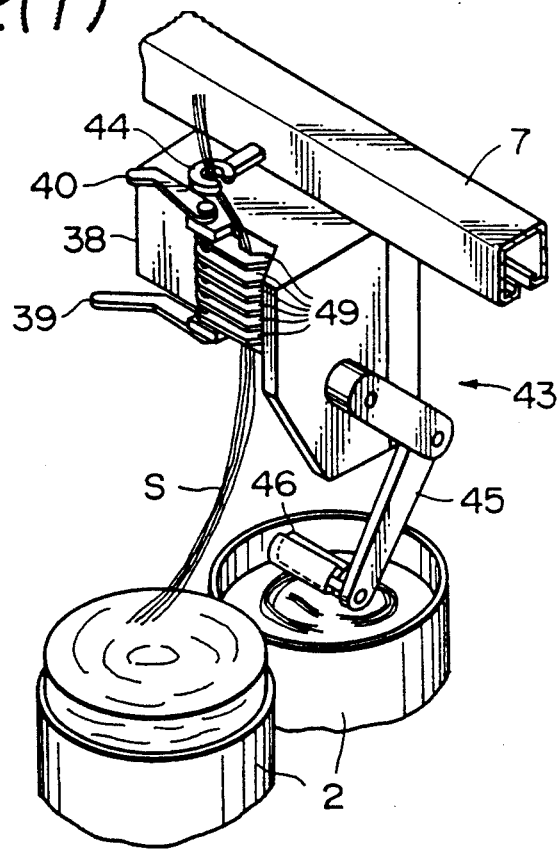
Figure 12J:
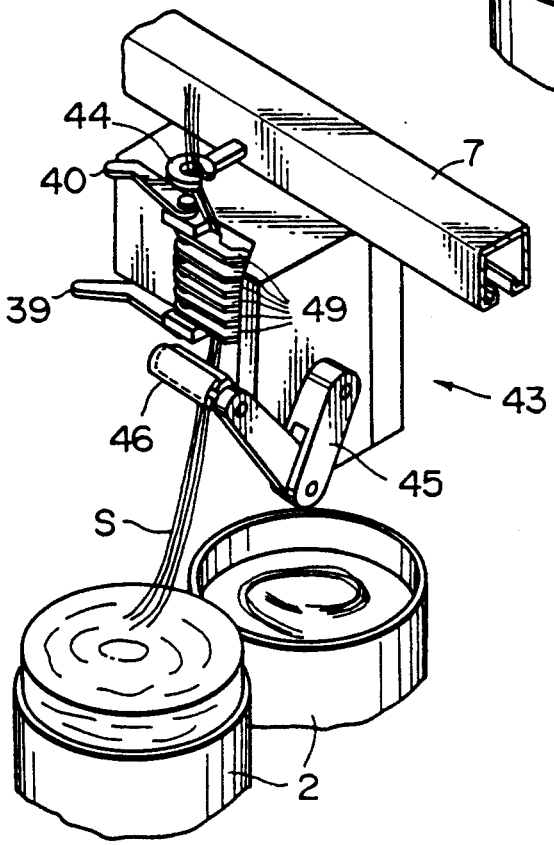
Figure 12K:
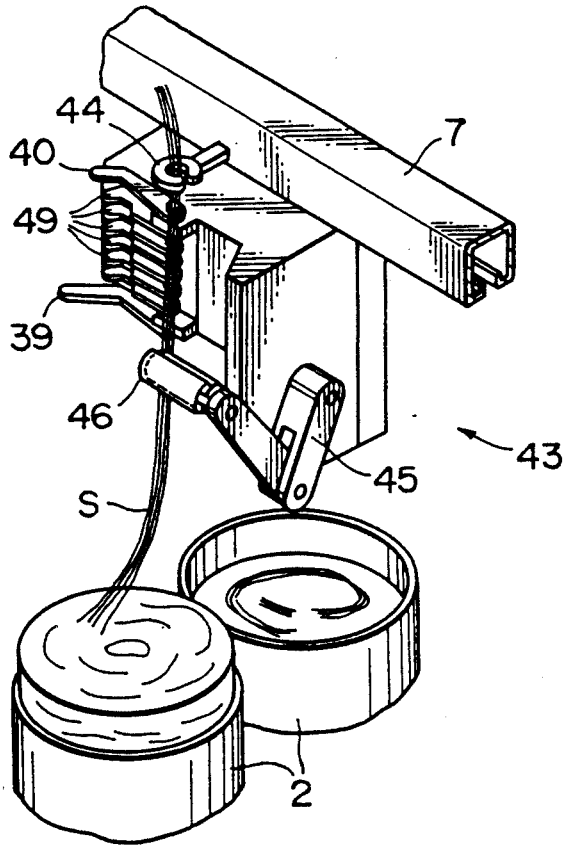
Figure 13A:
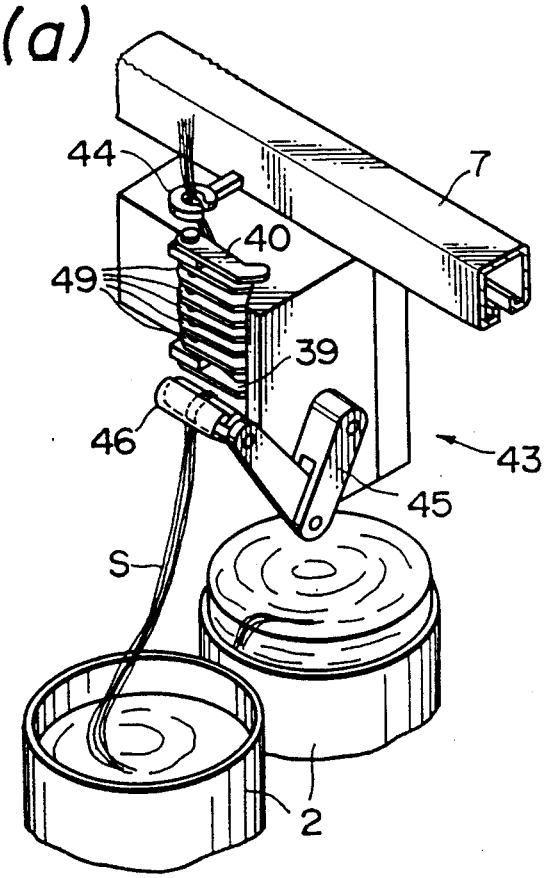
Figure 13B:
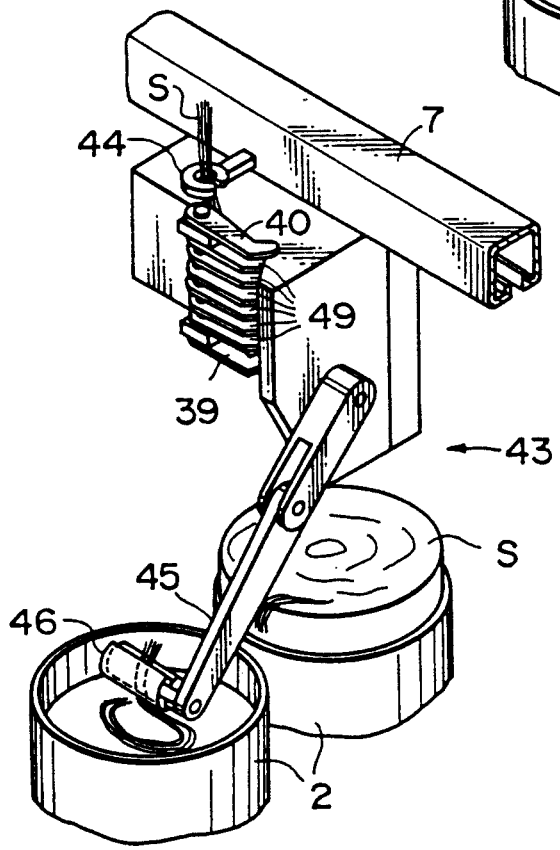
Figure 13C:
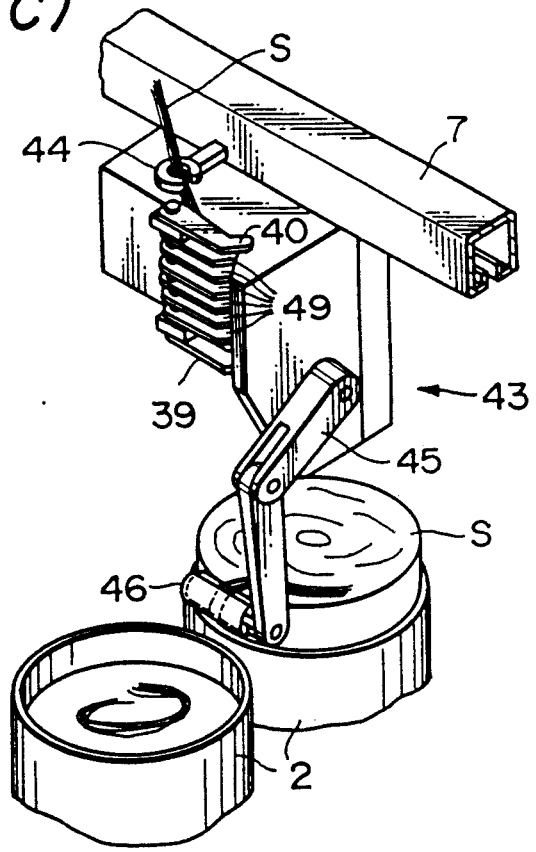
Figure 13D:
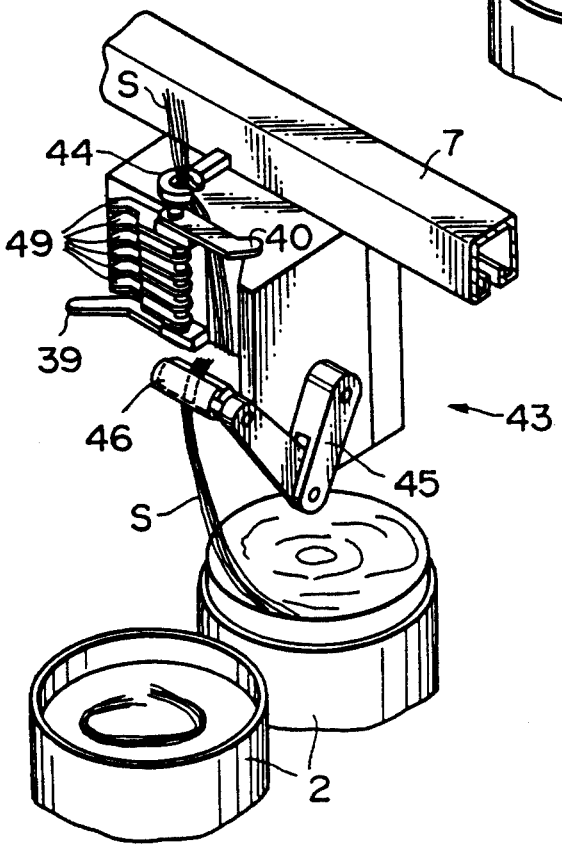

This embodiment has two major differences from the first embodiment; i.e., the sliver piecing operation is carried out on a sliver portion extending in the vertical direction, and a rail on which a sliver piecing device runs (which corresponds to a movable rail 7 in the first embodiment) is arranged along the respective row of cans. As shown in FIG. 9, a continuous rail 7 is provided along rows of cans 2 arranged in parallel to each other behind a roving frame 1. In the drawing, two roving frames are illustrated, each having four rows of cans, through which a common rail 7 is arranged. As shown in FIG. 10, a sliver piecing device 43 is provided to be displaceable along the rail 7 while confronting a sliver S delivered to the roving frame 1 from the can 2 through a guide 44 and a roller 42, at a portion between the can 2 and the guide 44. As shown in FIG. 11, an articulated arm 45 having a sliver gripper 46 on the free end thereof is mounted on the sliver piecing device 43. The sliver gripper 46 comprises a cylindrical body 47 with a suction slot 47*a* on the periphery thereof and a movable piece 48 driven by a rotary solenoid (not shown) to circumferentially slide on the body 47. The articulated arm 45 is movable in a plane transverse to the running direction of the sliver piecing device 43 by the drive means such as a reversible motor (not shown) secured at a shaft or an articulation, so that the sliver gripper 46 occupies a position above a sliver piecing unit 38 mounted on the front side of the sliver piecing device 43 and a position confronting a sliver end in the can 2. A sliver holding arm 40 and a sliver intake arm 39 are provided at the upper and lower are as of the sliver piecing unit 38, respectively. Also a group of pressers 49 are provided between the arms 39, 40 in correspondence with a sliver introduction recess 38*a*. The pressers 49 are rotatable integrally with each other.

The operation of the above mechanism will be described below.

The sliver piecing device 43 waits at the standby position until receiving a command from the central processing unit. Upon receiving the command, the sliver piecing device 43 moves along the rail 7 to a position corresponding to cans 2 on which the piecing operation is needed. As described in the first embodiment, the rail 7 has a positioning plate with a plurality of detection pieces provided thereon at a pitch, whereby the sliver piecing device 43 is made to stop upon counting a predetermined number of detection pieces. With reference to FIGS. 12(*a*) through 12(*k*), a sliver piecing operation will be explained when the exhaustion can is positioned closer to the rail 7, i.e., when the reserve can is positioned in front of the sliver piecing device 43.

When the sliver piecing device 43 occupies an operative position, as shown in FIG. 12(*a*), a sliver introduction recess 38*a* of a sliver piecing unit 38 confronts a vertically extending portion of a sliver S withdrawn from the exhaustion can 2 and merging into the roving frame 1 through a guide 44. Then the sliver intake arm 39 and sliver holding arm 40 are driven to introduce the sliver S into the recess 38*a*, as shown in FIG. 12(*b*), and the sliver gripper 46 is driven to catch the sliver S on the cylindrical body 47 by suction, and hold the same by the movable piece 48, as shown in FIG. 12(*c*). Then the articulated arm 45 is driven to move the sliver gripper 46 downward away from the sliver piecing unit 38, whereby the sliver in the exhaustion can is severed between the intake arm 39 and the sliver gripper 46. Thereafter, the suction through the suction slot 47*a* is stopped so that the sliver waste is dropped into the exhaustion can now empty, as shown in FIG. 12(*d*).

The articulated arm 45 is driven to move the sliver gripper 46 to confront the leading end portion of a sliver in the reserve can 2 as shown in FIG. 12(*e*). In this regard, the leading end portion of the sliver is arranged to hang down from the side wall of the reserve can. Accordingly, the leading end of the sliver is caught by the suction slot 47*a* and gripped by the movable piece 48. Then the pressers 49 and the sliver intake arm 39 are rotated to occupy a release position and the articulated arm 45 is driven to displace the sliver gripper 46 upward so that the sliver in the reserve can is raised up, as shown in FIG. 12(*f*). The motion of the articulated arm 45 is stopped when the sliver gripper 46 reaches a predetermined position just above the sliver holding arm 40, as shown in FIG. 12(*g*). Next, the pressers 49 is rotated to introduce the sliver into the recess 38*a* and hold the same. The articulated arm 45 is driven to displace the sliver gripper 46 upward, as shown in FIG. 12(*h*), so that the leading portion of the sliver withdrawn from the reserve can is severed to form a leading end which overlaps the trailing end of the first sliver already held in the recess 38*a*. The sliver intake arm 39 and the sliver holding arm 40 are rotated to the release position and the articulated arm 45 is driven to displace the sliver gripper 46 downward to a position corresponding to the exhaustion can now empty, as shown in FIG. 12(*i*), in which position the sliver waste held by the sliver gripper 46 is released therefrom and dropped into the empty can by the stoppage of the suction in the gripper 46 and displacement of the movable piece 48. Thereafter, the articulated arm 45 is returned to the standby position as shown FIG. 12(*j*).

The sliver piecing operation is carried out on the overlapped portions of the sliver ends by the action of the sliver piecing unit 38.

After completion of the sliver piecing operation, the sliver pressers 49 occupy a release position so that the sliver S now pieced together is removed from the recess 38*a*, as shown in FIG. 12(*k*), and the sliver piecing device 43 is then displaced to the next operating area.

Even if the exhaustion can is positioned in front of the sliver piecing device, the piecing operation is substantially identical to the above-described one, except that the steps in FIGS. 12(*c*) through 12(*f*) are replaced by those shown in FIGS. 13(*a*) through 13(*d*).

The present invention is not restricted to the above two embodiments applied to a sliver piecing in a roving frame, but is also applicable to a sliver piecing in a drawing frame, a carding engine, an open-end spinning frame, a fasciated yarn spinning frame, or a suction-twisting spinning frame.

Also, a silver in the reverse can may be introduced into the operative zone of the sliver piecing unit prior to the introduction of a sliver in the exhaustion can thereinto.

We claim:

1. A method of automatically positioning a trailing end of a first sliver in an exhaustion can and a leading end of a second sliver in a reserve can, in such a manner that said ends overlap each other, in an operative zone of a piecing unit by means of a sliver gripper movable apart from and close to the sliver piecing unit and grips the sliver therein and releases the same therefrom, wherein the method comprises the steps of:

displacing the sliver gripper close to the operative zone of the sliver piecing unit while holding a first sliver by the sliver gripper so that the first sliver is introduced into the operative zone of the sliver piecing unit;

fixedly holding the first sliver in the operative zone; displacing the gripper apart from the sliver piecing unit while holding the first sliver in the operative zone, so that the first sliver is severed at the operative zone to form a trailing end of the first sliver;

again displacing the sliver gripper close to the operative zone of the sliver piecing unit while holding a second sliver by the sliver gripper, so that the second sliver overlaps the trailing end of the first sliver held in the operative zone;

fixedly holding the overlapped portion of slivers in the operative zone; and again displacing the gripper apart from the sliver piecing unit while holding the second sliver in the operative zone, so that the second sliver is severed at the operative zone to form a leading end of the second sliver;

whereby the trailing and leading ends of slivers to be pieced together are positioned in the operative zone of the sliver piecing unit in an overlapping manner for the preparation of the piecing operation of the sliver piecing unit.

2. A method as defined in claim 1, wherein said steps for the second sliver are carried out prior to those for the first sliver.

* * * * *

UNITED STATES PATENT AND TRADEMARK OFFICE

CERTIFICATE OF CORRECTION

PATENT NO. : 4,987,645

DATED : January 29, 1991

INVENTOR(S) : Yoshio Kawasaki, et al

It is certified that error appears in the above-identified patent and that said Letters Patent is hereby corrected as shown below:

In the title page:, item [75]Inventors, line 3 : change "Horibe" to --Fujieda--.

Item 73 Assignee: Please add the following assignees:

--Nisshinbo Industries, Inc., and

Kabushiki Kaisha Hara Shokki Seisakusho--.

Signed and Sealed this

Fifteenth Day of September, 1992

*Attest:*

DOUGLAS B. COMER

*Attesting Officer*

*Acting Commissioner of Patents and Trademarks*